United States Patent [19]

Kuhn

[11] Patent Number: 4,689,842

[45] Date of Patent: Sep. 1, 1987

[54] PATIENT MOTIVATION DEVICE

[76] Inventor: George C. Kuhn, 228 E. Commercial St., East Rochester, N.Y. 14445

[21] Appl. No.: 935,016

[22] Filed: Nov. 26, 1986

[51] Int. Cl.[4] ..... A61G 7/10; A61G 7/02

[52] U.S. Cl. ..... 5/61; 5/81 R; 5/90

[58] Field of Search ..... 5/61, 81 R, 81 B, 82 R, 5/83, 84, 89, 90, 463

[56] References Cited

U.S. PATENT DOCUMENTS

| | | | |
|---|---|---|---|
| 1,334,901 | 3/1920 | Higdon | 5/61 |
| 3,284,816 | 11/1966 | Laubsch | 5/81 R |
| 3,811,140 | 3/1974 | Burpo | 5/90 |
| 3,829,914 | 8/1974 | Treat | 5/81 R |
| 3,959,832 | 6/1976 | Parsons | 5/84 |
| 4,347,635 | 9/1982 | Eisenhauer | 5/82 R |
| 4,472,848 | 9/1984 | Newman | 5/81 R |

*Primary Examiner*—Gary L. Smith
*Assistant Examiner*—Michael F. Trettel
*Attorney, Agent, or Firm*—Robert M. Phipps

[57] ABSTRACT

Bedridden persons are aided in the use of bed pans and the like by placing the person on a full length platform with an opening so located that the excreted waste falls directly into the bed pan below the platform. The platform is supported above the patient's bed by a series of rigid and resilient supports which work in combination to assist in the placement of the person on the platform.

6 Claims, 3 Drawing Figures

PATIENT MOTIVATION DEVICE

BACKGROUND

1. Field of the Invention

This invention relates to the caring for the excretory functions of bedridden patients.

2. Description of the Prior Art

The care of a bedridden patient over the years has been unsatisfactory with respect to on going body functions such as the excretory organs. It has reached the point that jokes and sad stories about patients' use of bedpans are legion. In U.S. Pat. No. 266,167 (1882) A. Leslie disclosed an invalid hammock which was fastened at the foot of the bed, passed over the very high head board and down the back side of the head board to a crank operated drum. By this means slack in the hammock could be reduced, thus suspending the patient or slack let out to lower the patient. The patient could be lowered down on to the bed's mattress. To enable the patient to use the bed pan without leaving the hammock, an opening, where the buttocks usually come, was provided. The opening could be covered with a flap. As is commonly known, this concept was not adopted as practical.

J. A. Devore, et al in U.S. Pat. No. 778,570 (1904) disclosed an invalid bed in which a stretcher was installed on a telescoping frame. The stretcher could be raised from the mattress, by a crank mechanism at the foot of the bed, a sufficient distance from the mattress to insert a vessel, i.e., bed pan and the like, under the hole in the stretcher. It was intended that the patient be continuously on the stretcher. Preferably, the stretcher was made of waterproof material. Again, this device was not adopted by the public as a practical means of caring for the bedridden patient. One can readily imagine the bedridden patient's comfort on such a device.

F. T. Rodley, in U.S. Pat. No. 1,981,666 (1934) disclosed an inflatable device for use as a bed lift and to support patients in conjunction with, among other things, use of bed pans. The device anchored at the head and foot of the bed, is continuously maintained beneath the patient. Because of its waterproof construction, the long term patient's discomfort will be readily apparent.

Finally, mention is made of the invalid hammock disclosed by V. Parsons in U.S. Pat. No. 3,959,832 (1976). The hammock is suspended from adjustable posts over a bed. The patient can be kept permanently on the hammock, elevated sufficiently above the mattress to prevent contact therewith of any parts of their body projecting through the holes in the hammock. When used in this manner the hammock prevents bed sores on the patient because the pressure points of the person's body do not touch the mattress at all, but the bed is still there to prevent injury in case the hammock should slip down.

Thus, there remains a great need for a comfortable, easy to use device to assist bedridden patients in their use of bed pans and the like. It is an object of this invention to provide a device for assisting bedridden patients in the exercise of their excretory functions. It is a further object of this invention to provide a convenient, lightweight, comfortable and reusable device which is only associated with the patient while the patient is engaged in excretory functions. Still other objects will be apparent to those skilled in the art upon reference to the following detailed description.

SUMMARY OF THE INVENTION

In accordance with this invention, there is provided a device for assisting attendants in the moving of bedridden patients for the exercise of their excretory functions comprising:

(1) a substantially rigid rectangular platform for supporting a patient thereon, said platform including an opening therein so located that waste excreted by said patient falls into waste collector underneath said opening without touching said platform, and (2) a plurality of substantially rigid vertical supports formed on the underside of said platform for supporting said platform at a predetermined distance above the surface on which said patient is reposed, each of said vertical supports including a resilient member thereon said resilient member extending from said vertical support outwardly and around one of the longer edges of said platform, whereby said resilient member is initially compressed by contact with the patient as the patient is moved from a place of repose over to and on to said platform edge thereby tilting said platform and as said patient is fully moved on to said platform, said resilient member is released from compression to return to its original state thereby allowing said platform to return to its original position supported by said rigid vertical supports.

DESCRIPTION OF THE PREFERRED EMBODIMENT

Figure 1:
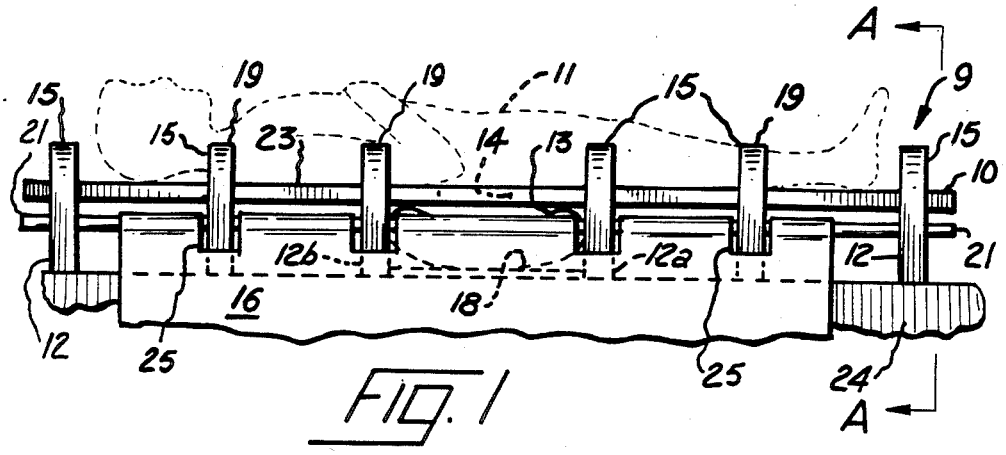
FIG. 1 is a side view of patient platform of this invention being used by a patient.
Figure 2:
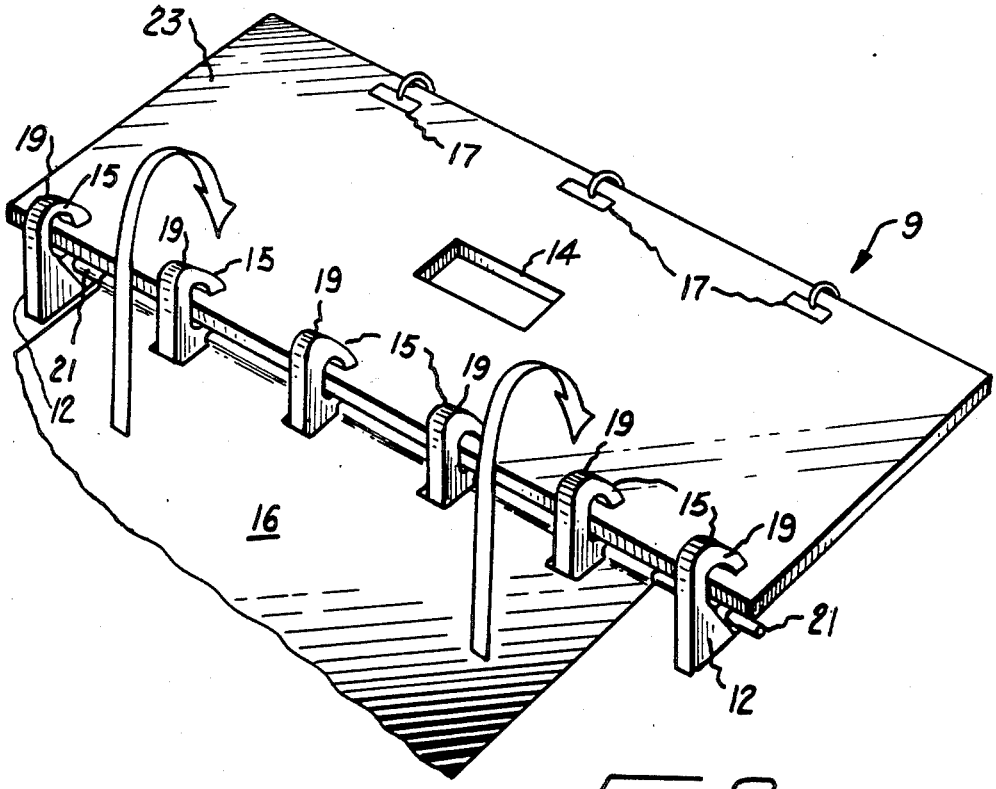
FIG. 2 is a plan view of the patient platform ready to receive a patient.

The patient platform 9 as shown in FIG. 1 is made up of a patient carrier 10 supported by a series of stiff (that is substantially rigid vertical) carrier supports 12. In use the patient 11 rests on the upper side of the patient carrier 10 and is so positioned that their excretory openings (anus and urinary) are suspended over an opening 14 as best seen in FIG. 2 which forms a communicating passageway between the patient 11 and collector, e.g. a bed pan 13. In use, bed pan 13 is positioned under the patient support 10 and between stiff supports 12*a* and 2*b*. Optionally, a surface protector 18 may be installed between supports 12*a* and 12*b* under the patient support 10 so that the surface on which the patient platform 9 rests, e.g., a bed 24, will not be soiled.

In FIG. 2 the opening 14 in patient support 10 to bed pan 13 is shown. Along one side of the patient support 10 and at the end of each stiff support 12 is located a resilient elevating carrier support 15. The stiff support 12 and resilient support 15 may be combined into one support with two functions, one on each side, or these supports can be two separate pieces as shown in FIG. 2. The resilient carrier support 15 is so configured as to enhance its resiliency in permitting the patient platform 9 to be depressed to the surface, e.g. of the bed 24, and to provide anchoring or engagement means for the lifting sheet 16. The lifting sheet 16 functions both as a means of moving the patient 11 from the bed to the patient platform 9 and as a modesty shield for the patient 11 while using the bed pan 13.

Figure 3:
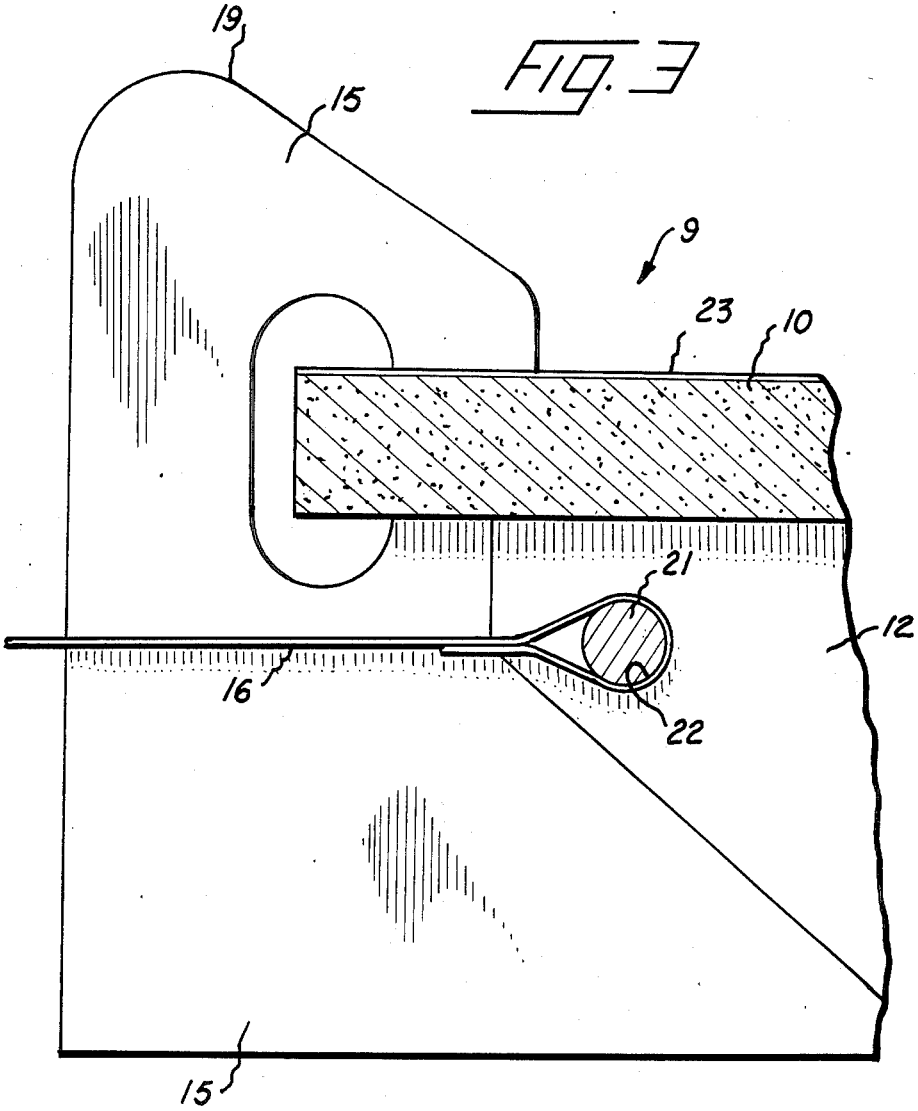
FIG. 3 is an enlarged sectional view taken along line "A—A" of FIG. 1.

The lifting sheet 16 is maintained in place on the patient platform 9 by the attachment at the lower surface of patient carrier 10. This attachment can be of several forms as desired, e.g., tabs on sheet 16 snap fastened to carrier 10, or a zipper substituted for the snaps, or loop tabs on sheet 16 which slide over a rod 21 (or pipe) retained in rod aperture 22 of rigid support 12 as shown in FIG. 3. Appropriate openings 25 are provided in lifting sheet 16 so that it rotates over and around the upper portion 19 of resilient support 15 when the sheet 16 is being used to move the patient onto the platform 9. The lifting sheet 16 when used as a modesty cover is maintained in position over the patient 11 by use of clips 17 or snaps or interlocking fabric closures.

The relationship of stiff support 12 and resilient support 15 is more particularly shown by the end view of the patient platform 9 in FIG. 3. As shown, the end of stiff support 12 slopes away from the edge of and underneath patient platform 10. The end of support 15 has a reverse, but complementing slope, with respect to stiff support 12, so that there is a continuous support under carrier 10. Stiff support 12 is permanently affixed to carrier 10 where as resilient support 15 when not an integral part of rigid support 12 may be removably affixed In use, when the patient 11 desires to use the bed pan 13, the attendant brings the patient platform 9 to the patient's 11 bed 24 or guerney etc., and positions it along side of and behind the patient 11. Then the lifting sheet 16, attached to the platform 9, is passed under the patient 11. The free edge of the lifting sheet 16 is then pulled over to and across the platform 9. As the lifting sheet 16 is pulled, the patient 11 is rolled over to and on to the carrier 10 without lifting by the attendant and positioned over opening 14. The patient is then ready to use the bed pan 13.

As the patient 11 is rolled on to the carrier 10, the force exerted by the patient 11 on the anchored side of the lifting sheet causes the resilient supports 15 to compress and deflect or tilt the carrier 10. When fully deflected, the edge of carrier 10 is substantially at the surface level of the bed, etc. As the patient continues to roll on to the carrier 10, their weight is shifted over to the part supported by the stiff supports 12. This shifting over causes the carrier 10 to pivot or rotate back to its normal level position.

After the bed pan 13 has been used and removed the patient 11 is returned to their original position by the reverse rolling motion. The attendant may reach over the carrier 10 and patient 11 to grip the free edge of the lifting sheet 16 or may be assisted in gripping the lifting sheet 16 by the use of rods hooked into or straps (not shown) attached to the free edge of the lifting sheet 16.

The preferred design of the patient platform 9 is to help lift the patient 11 approximately 6 inches (15 cm) above the bed 24 to allow the entrance of a bed pan 13 without a lot of lifting or pressure to the attendant. It is designed to cushion the patient 11 in the downward position and the cushion memory will act like a spring and help in moving the patient 11 six to eight inches (15 to 20 cm) above the bed 24 by pulling on the lifting sheet 16 under the patient 11.

With the patient 11 lifted six or eight inches (15 to 20 cm) above the bed 24, the bed pan 13 can easily be placed into position or it can be removed from under the patient 11 without any effort on the part of the patient 11 and very little on the part of the person extracting the pan 13.

This method will improve the condition of the patient 11. They will be in a dry bed 24 and they can be bathed on the patient platform 9 without having water absorbed in the bed 24. The water will drain into the an under the patient 11.

If the patient 11 has bowel problems the patient 11 can be maintained over the bed pan 13 for long periods of time if necessary without discomfort. The patient 11 will not even know it is underneath.

The patient platform 9 can also be utilized when it is necessary to give a patient 11 an enema. The pan 13 will be in place and the patient 11 will not have to have discomfort when the enema is withdrawn.

The clean, simple design of this patient platform 9 provides a number of advantages. To the patient it means not having to lay in an awkward position while using a bed pan, to say nothing of avoiding a cold bed pan. Additionally, the attendant is freed of the hard lifting effort required to simultaneously lift the patient and slide the bed pan underneath. Additional patient comfort can be achieved when the patient receiving surface 23 of the patient platform 9 is covered with a thin layer of resilient closed cell cellular material. This material may be permanently attached to the platform 9 if so desired. The patient platform 9 is light weight and under ordinary use is very long lasting and easy to store. The materials of construction employed also make the platform 9 easy to clean and maintain. Additionally the platform 9 has sufficient flexibility to compensate for any irregularity in the surface of the bed 24. But, above all it provides a high degree of patient comfort not previously obtainable.

The patient platform 9 can be constructed of a variety of inexpensive materials as desired. Greater portability, ease of cleaning and greater patient comfort, however, is achieved when a rigid closed cell cellular material is used for the patient carrier 10 and stiff supports 12 plus surface protector 18. These parts can be molded separately and then assembled or molded as a unit by methods well known in the molding art. Additionally, stiff support 12 and resilient support 15 can be made from separate pieces of appropriate materials and with adhesive be permanently joined together or these two parts can be molded in the same step from different materials. In any event the rigid parts can be made from numerous polyurethane, polypropylene, polyethylene, polyvinyl chloride and the like polymeric compositions. Such materials are well known in the art. The thickness of these parts and density of the foam will vary depending upon the physical properties of the polymer and the size of patient to be supported. These parameters are readily understood by those skilled in the design and molding arts.

The resilient carrier support 15 is preferably also made of molded closed cell polymeric foam compositions. It is very desirable that these compositions be characterized by high degree of compressibility and substantially a complete recovery to original shape upon release from compression. These foams are characterized by low densities. A typical trademark for foams of this type is Ethafoam a trademark of Dow Chemical Co.

The lifting sheet maybe made from such fabrics as desired. Among the more preferred sheeting materials is tight woven nylon.

The foregoing examples and methods have been described in the foregoing specification for the purpose of illustration and not limitation. Many other modifications and ramifications will naturally suggest themselves to those skilled in the art based on this disclosure. These are intended to be comprehended as within the scope of this invention.

The embodiments of the invention in which as exclusive property or privilege is claimed are defined as follows:

1. A device for assisting attendants in moving bedridden patients for their excretory functions comprising:

(1) a substantially rigid rectangular platform for supporting a patient thereon, said platform including an opening therein so located that waste excreted by said patient falls into waste collector underneath said opening without touching said platform, and (2) a plurality of substantially rigid vertical supports formed on the underside of said platform for supporting said platform at a predetermined distance above the surface on which said patient is reposed, each of said vertical supports including a resilient member thereon said resilient member extending from said vertical support outwardly and around one of the longer edges of said platform, whereby said resilient member is initially compressed by contact with the patient as the patient is moved from a place of repose over to and on to said platform edge thereby tilting said platform and as said patient is fully moved on to said platform, said resilient member is released from compression to return to its original state thereby allowing said platform to return to its original position supported by said rigid vertical supports.

2. The device of claim 1 wherein the vertical support member is an unitary support having a rigid section and at one side a resilient section.

3. The device of claim 1 wherein said resilient supports are removably attached to said rigid vertical supports of said patient platform.

4. The device of claim 1 which further includes a protector sheet underneath the waste collector, said protector sheet being affixed between at least one pair of said rigid support members.

5. The device of claim 1 which further includes a resilient closed cell cellular sheet affixed to the surface of said support platform which receives the patient.

6. A method for assisting bedridden patients in their excretory functions comprising a. passing a lifting sheet underneath at least the greater length of the patient, said lifting sheet being attached behind the patient to a device comprising:

(1) a substantially rigid rectangular platform for supporting a patient thereon, said platform including an opening therein so located that waste excreted by said patient falls into waste collector underneath said opening without touching said platform, and (2) a plurality of substantially rigid vertical supports formed on the underside of said platform for supporting said platform at a predetermined distance above the surface on which said patient is reposed, each of said vertical supports including a resilient member thereon said resilient member extending from said vertical support outwardly and around one of the longer edges of said platform, b. pulling said lift sheet toward said patient platform whereby said resilient member is initially compressed by contact with the patient as the patient is moved from a place of repose over to and on to said platform edge thereby tilting said platform and as said patient is then fully moved on to said platform said resilient support is released from compression to return to its original state thereby allowing said platform to return to its original shape supported by said rigid vertical supports, and c. placing a waste collector underneath said opening and allowing said patient to excret said waste.

* * * * *